US009532648B2

(12) United States Patent
Gasser et al.

(10) Patent No.: US 9,532,648 B2
(45) Date of Patent: Jan. 3, 2017

(54) DRIVE DEVICE FOR A MOVABLE FURNITURE PART

(71) Applicant: Julius Blum GmbH, Hoechst (AT)

(72) Inventors: Ingo Gasser, Hoechst (AT); Michael Blum, Hoechst (AT); Hermann Haemmerle, Lustenau (AT)

(73) Assignee: Julius Blum GmbH, Hoechst (AT)

( * ) Notice: Subject to any disclaimer, the term of this patent is extended or adjusted under 35 U.S.C. 154(b) by 0 days.

(21) Appl. No.: 14/861,211

(22) Filed: Sep. 22, 2015

(65) Prior Publication Data

US 2016/0007748 A1 Jan. 14, 2016

Related U.S. Application Data

(63) Continuation of application No. PCT/AT2014/000060, filed on Mar. 26, 2014.

(30) Foreign Application Priority Data

Apr. 12, 2013 (AT) ..... 291/2013

(51) Int. Cl.
*A47B 88/00* (2006.01)
*A47B 88/04* (2006.01)
(Continued)

(52) U.S. Cl.
CPC ..... *A47B 88/0477* (2013.01); *A47B 88/0466* (2013.01); *A47B 88/0481* (2013.01);
(Continued)

(58) Field of Classification Search
CPC . A47B 88/0466; A47B 88/0477; A47B 88/16; A47B 88/0407; A47B 88/14; A47B 2008/0048; E05B 65/463
(Continued)

(56) References Cited

U.S. PATENT DOCUMENTS 5,498,039 A * 3/1996 Bivens ..... A47B 88/0477 292/145
8,807,671 B2 8/2014 Brunnmayr
(Continued)

FOREIGN PATENT DOCUMENTS

AT 508139 * 11/2010
AT 511 938 4/2013
(Continued)

OTHER PUBLICATIONS

International Search Report issued Jul. 25, 2014 in corresponding International Application No. PCT/AT2014/000060 (with English translation).

*Primary Examiner* — Janet M Wilkens
(74) *Attorney, Agent, or Firm* — Wenderoth, Lind & Ponack, L.L.P.

(57) ABSTRACT

A drive device for a movable furniture part includes an ejecting element for moving the movable furniture part from a closed position to an open position, an ejection force accumulator that applies force to the ejecting element, and a locking device for locking the ejecting element by a locking element in a locking section. The locking device can be unlocked by overpressing the movable furniture part from the closed position to an overpressing position in the closing direction. The movable furniture part can be moved in the opening direction by the ejection force accumulator and the ejecting element, and the locking device has a pre-locking section for the locking element. The locking element is moved from the pre-locking section into the locking section via a push-through evasion section by pushing the movable furniture part during closing into a push-through position behind the closing position in the closing direction.

19 Claims, 15 Drawing Sheets

(51) Int. Cl.
*A47B 88/14* (2006.01)
*A47B 88/16* (2006.01)
*E05B 65/46* (2006.01)

(52) U.S. Cl.
CPC ..... *A47B 88/14* (2013.01); *A47B 88/16* (2013.01); *E05B 65/463* (2013.01)

(58) Field of Classification Search
USPC ..... 312/333, 319.1, 334.44, 334.6
See application file for complete search history.

(56) References Cited

U.S. PATENT DOCUMENTS

| | | | | |
|---|---|---|---|---|
| 9,295,329 | B2 | 3/2016 | Brunnmayr et al. | |
| 2007/0090735 | A1 | 4/2007 | Hashemi et al. | |
| 2014/0021841 | A1 | 1/2014 | Brunnmayr | |
| 2014/0319986 | A1 | 10/2014 | Brunnmayr | |
| 2015/0097473 | A1* | 4/2015 | Brunnmayr ..... | A47B 88/0481 312/319.1 |
| 2015/0374125 | A1* | 12/2015 | Goetz ..... | A47B 88/0481 312/319.1 |
| 2016/0135595 | A1* | 5/2016 | Erdel ..... | A47B 88/0085 312/333 |

FOREIGN PATENT DOCUMENTS

| | | |
|---|---|---|
| AT | 514059 | * 10/2014 |
| AT | 514065 | * 10/2014 |
| AT | 514865 | * 4/2015 |
| DE | 20 2008 001 884 | 5/2008 |
| DE | 102008014871 | * 9/2009 |
| DE | 20 2009 005 256 | 12/2010 |
| DE | 10 2009 026 141 | 1/2011 |
| DE | 202011000362 | * 8/2011 |
| DE | 10 2011 002 212 | 10/2012 |
| DE | 202013004141 | * 8/2013 |
| EP | 2 272 400 | 1/2011 |
| EP | 2 279 680 | 2/2011 |
| JP | 2012-239738 | 12/2012 |
| JP | 2012-531991 | 12/2012 |
| JP | 2014-516649 | 7/2014 |
| JP | 2015-525622 | 9/2015 |
| WO | 2012149587 | * 11/2012 |
| WO | 2013/073489 | 5/2013 |

* cited by examiner

SS

ÜS

DRIVE DEVICE FOR A MOVABLE FURNITURE PART

BACKGROUND OF THE INVENTION

The invention concerns a drive device for a moveable furniture part, comprising an ejection element for moving the moveable furniture part from a closed position into an open position, an ejection force storage means which acts with force on the ejection element, and a locking device for locking the ejection element by way of a locking element in a locking portion. By over-pressing the moveable furniture part from the closed position in the closing direction into an over-pressing position, the locking device can be unlocked whereby the moveable furniture part is moveable in the opening direction by the ejection force storage means and the ejection element. The invention also concerns an article of furniture comprising a furniture carcass, a furniture part moveable relative to the furniture carcass and a drive device according to the invention for the moveable furniture part.

Drive devices have already been known for many years in the furniture fitting industry, with which by pressing against the moveable furniture part (for example a drawer) unlocking of that moveable furniture part from the furniture carcass takes place and then the moveable furniture part is opened or ejected. Such drive devices have a so-called touch latch mechanism. With that mechanism, the movement for closing the drawer from the open position and the movement for unlocking or opening the drawer from the closed position are in the same direction, namely in the closing direction. In the case of normal soft closure (manually or by a retraction device) the drawer or the moveable furniture part is held in the closed position by the locking device. If, however, the drawer is pushed shut excessively firmly or if it is pushed through as far as an end abutment the ejection device can no longer lock at all or is immediately triggered again, whereby there is no guarantee of the drawer being securely closed in the event of such incorrect operation of the moveable furniture part.

To resolve that problem, a blocking element is known from Austrian patent application A 52/2012 which is of earlier priority date but which is not a prior publication in order to prevent the movement into the over-pressing position in the event of excessively fast closing movement.

SUMMARY OF THE INVENTION

The object of the present invention is to provide an alternative possible way of preventing direct triggering or unlocking of the ejection device even in the event of incorrect operation by pushing the moveable furniture part through.

Accordingly, the locking device has a pre-locking portion for the locking element, wherein by pressing the moveable furniture part through upon closing thereof into a through-pressing position behind the closed position in the closing direction, the locking element passes from the pre-locking portion into the locking portion by way of a through-pressing evasion portion. Thus, upon locking for the first time, the locking element does not immediately pass into the locking portion but is held in the pre-locking portion which has its own through-pressing evasion portion, from which the locking element cannot be directly ejected, but firstly passes into the actual locking portion. To permit that the locking portion should be different from the pre-locking portion. In particular the locking portion should be spaced from the pre-locking portion in the opening direction of the moveable furniture part. In other words, the pre-locking portion is behind the locking portion in the closing direction.

In itself such a through-pressing protection arrangement can be appropriately used in various design configurations of touch latch mechanisms like, for example, in those mechanisms which function on the basis of the ballpoint pen principle. Preferably, however, the locking device has a preferably cardioid-shaped guide path for the locking element which is preferably of a pin-shaped configuration. The locking element can be held or locked in the locking portion in a preferably trough-shaped latching region of the preferably cardioid-shaped guide path. Preferably, in the design configuration of the locking device having such a cardioid-shaped guide path, the guide path successively has a preferably straight stressing portion, a preferably curved deflecting portion, the pre-locking portion, the locking portion in the form of a preferably trough-shaped latching region (latching recess), an inclined diversion or unlocking portion and an ejection portion. In order also to permit normal ejection or unlocking it is further preferable that between the inclined unlocking or diversion portion and the ejection portion. the guide path has a second evasion portion separate from the through-pressing evasion portion for the locking element.

According to a particularly preferred embodiment of the invention. a holding element for the locking element is arranged or provided in the pre-locking portion.

According to a first variant for that holding element, in the pre-locking portion, the guide path has a straight contact surface for the locking element, as the holding element. That straight contact surface is so oriented that the force acting from the ejection force storage member on the locking element holds the locking element against that surface. Preferably the forces act substantially normally on that straight contact surface.

As a second variant of this holding element, the holding element is in the form of a moveable damping element, preferably in the form of a rotational damper.

Naturally, instead of a rotational damper, it is also possible to use a damping piston moveable with a translatory action or the like. It is preferable that the damping element has a dampedly rotatably mounted gear, wherein at least one tooth of the gear can be contacted in the pre-locking portion by the locking element and is dampedly moveable in the direction of the locking portion. Therefore the locking element is not statically held in the pre-locking portion with that damping element, but moves slowly in the direction of the locking portion. If therefore in that time when the locking element is still in contact with the damping element, the moveable furniture part is pushed through into the through-pressing position, the locking element firstly deflects into the through-pressing evasion portion, instead of passing directly into the ejection portion by way of the inclined diversion or unlocking portion.

As is known per se, the ejection force storage member can be loaded by moving the moveable furniture part in the opening direction and/or in the closing direction. Preferably, the ejection element is lockable in the pre-locking portion by way of the locking element only after complete loading of the ejection force storage member. In other words the ejection force storage member is fully stressed upon locking by way of the locking element in the pre-locking portion.

Preferably, the drive device has a retraction device for retraction of the moveable furniture part from an open position into the closed position, in which case—when the locking element reaches the pre-locking portion—the moveable furniture part is in an open position and the moveable furniture part is moveable from that open position into the closed position by the retraction device.

Particularly, when the holding element is in the form of a straight contact surface, preferably for the movement of the locking element into the locking portion, the locking element is moveable from the pre-locking portion into the locking portion only in the movement of the moveable furniture part by the retraction device into the closed position. It is particularly advantageous in that respect if the locking element is moveable from the pre-locking portion into the locking portion in dependence on the retraction device.

In principle, the drive device can be arranged on the furniture carcass and can eject the moveable furniture part by way of the ejection element. Preferably, however, the drive device is arranged on the moveable furniture part and an entrainment portion which can be brought into engagement with the ejection element is arranged on the furniture carcass. Thus, the drawer so-to-speak pushes itself away from the furniture carcass by way of the drive device.

BRIEF DESCRIPTION OF THE DRAWINGS

Further details and advantages of the present invention will be described more fully hereinafter by means of the specific description with reference to the embodiments by way of example illustrated in the drawings in which.

DETAILED DESCRIPTION OF THE DRAWINGS

Figure 1:
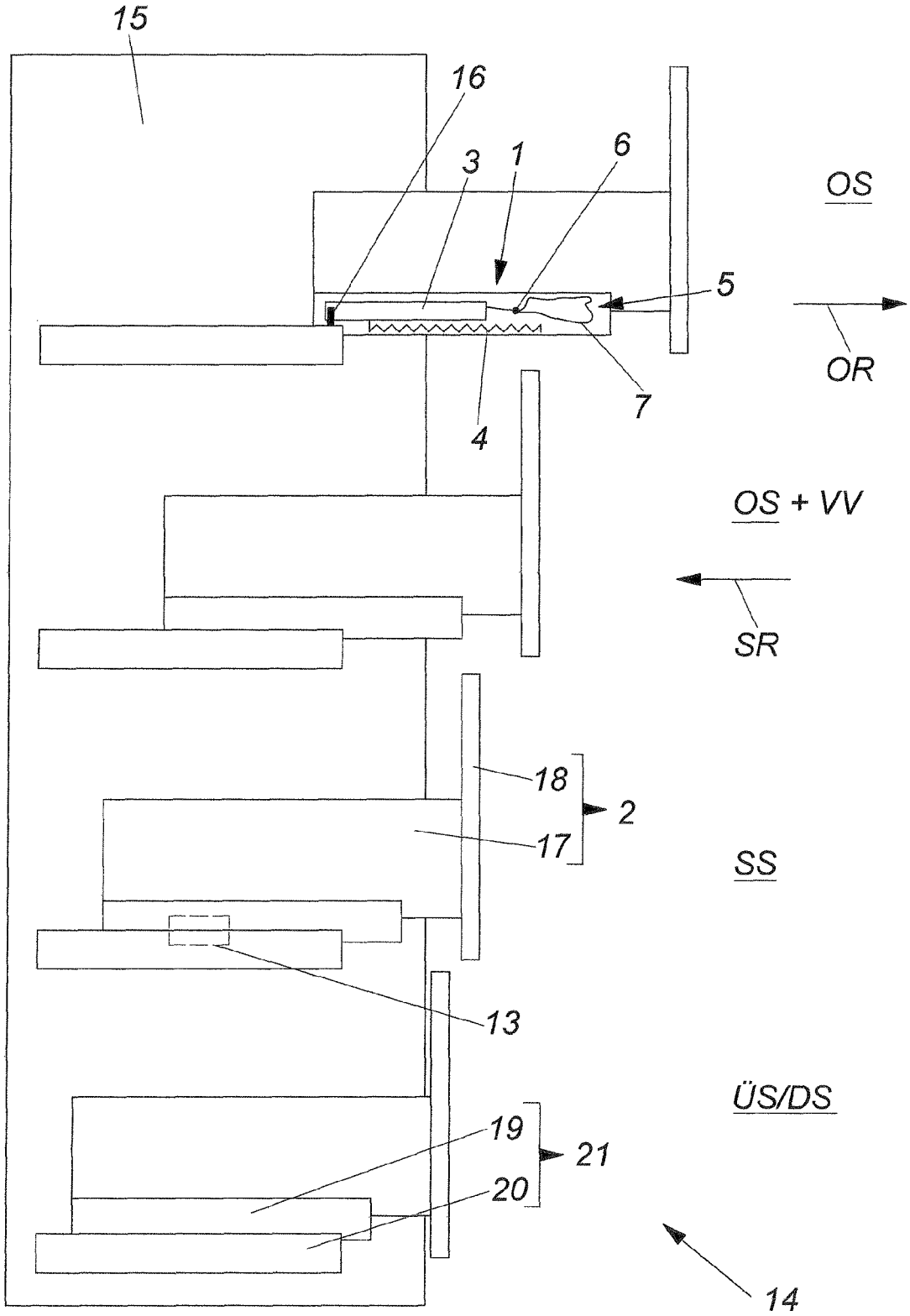
FIG. 1 diagrammatically shows various positions of a moveable furniture part in a furniture carcass.

FIG. 1 quite generally shows an article of furniture 14 comprising a furniture carcass 15 and a total of four moveable furniture parts 2. Each furniture part 2 comprises at least a drawer container 17 and a front panel 18. The moveable furniture parts 2 are mounted to the furniture carcass 15 by way of an extension guide means 21 comprising a drawer rail 19, a carcass rail 20 and optionally a central rail (not shown). It can be seen in relation to the topmost drawer that the drive device 1 together with the ejection element 3, the locking element 6 moveable in the guide path 7 and the ejection force storage member 4, is fixed or arranged on the moveable furniture part 2 or on its drawer rail 19. The locking device 5 is formed by the guide path 7 and the locking element 6. Arranged on the carcass rail 20 or on the furniture carcass 15 itself is an entrainment portion 16 with which the ejection element 3 is at least portion-wise in engagement. That topmost drawer is in the open position OS. When the drawer is further moved in the closing direction SR from that open position OS the locking element 6 passes into the pre-locking portion VV of the guide path 7 (see in detail FIG. 5 which is described hereinafter). In that position (second drawer from the top), the ejection force storage member 4 is fully stressed and the moveable furniture part 2 can then be moved into the closed position SS (third drawer from the top) by the retraction device 13 (only diagrammatically shown) integrated into the extension guide 21. Starting from that closed position SS the moveable furniture part 2 moves into the over-pressing position ÜS (lowermost drawer in FIG. 1), in a normal unlocking and opening process. That over-pressing position also precisely corresponds to the through-pressing position DS in relation to the moveable furniture part 2. In this arrangement, however, the locking element 6 is disposed in the drive device 1 in different portions (through-pressing evasion portion D or second evasion portion W). After the normal over-pressing action which is performed in the closing direction SR the moveable furniture part 2 is ejected in the opening direction OR by the drive device 1.

Figure 2:
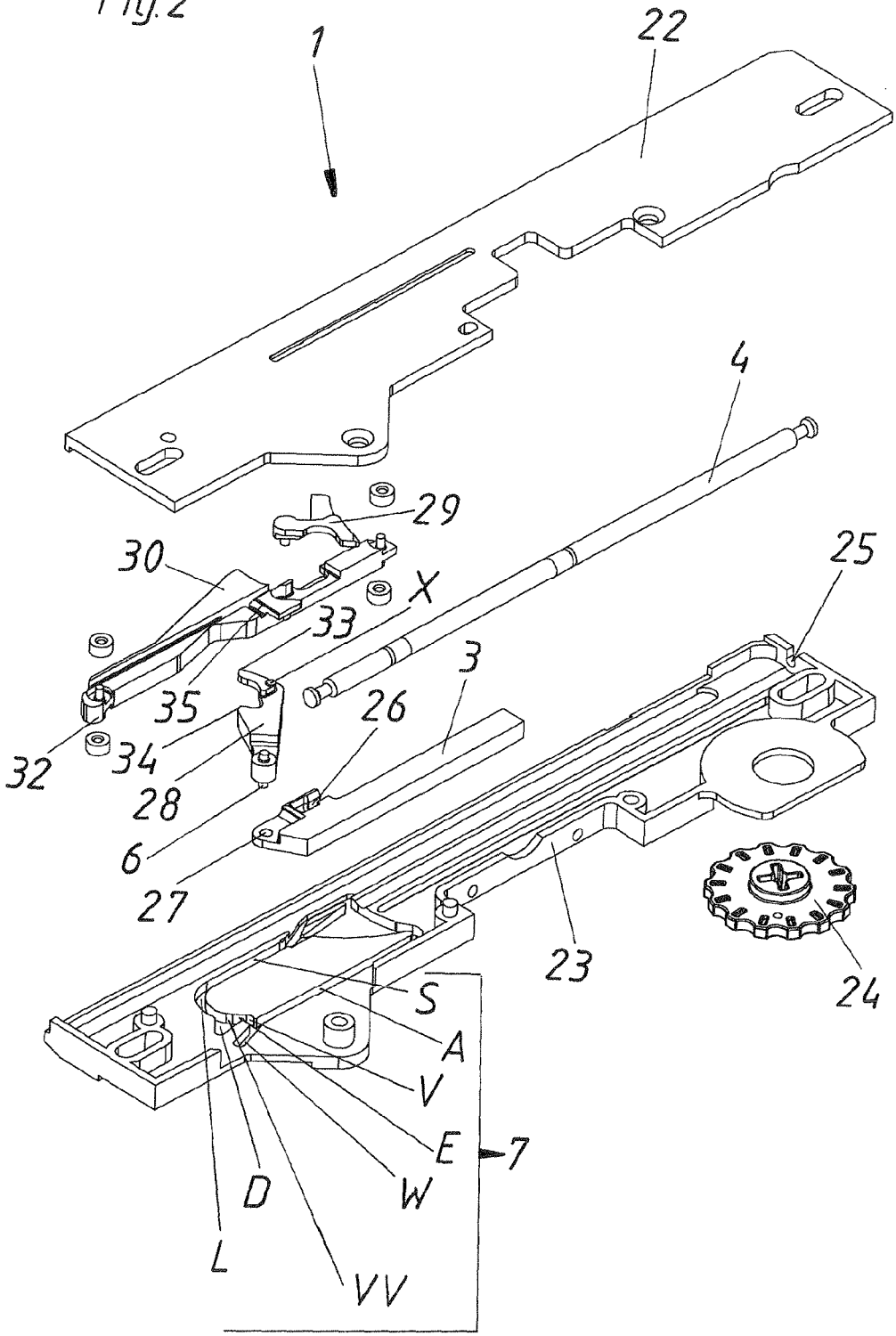
FIG. 2 is an exploded view of a first embodiment of a drive device.

FIG. 2 is an exploded view showing the essential components of a first embodiment of the drive device 1. That drive device 1 is fixed by way of the base plate 23 to the moveable furniture part 2 or to the drawer rail 19. In turn the cover 22 is mounted to the base plate 23. Provided in the base plate 23 is the guide path 7 with the stressing portion S, the deflecting portion L, the pre-locking portion VV, the through-pressing evasion portion D, the locking portion V, the inclined diversion and unlocking portion E, the second evasion portion W and the ejection portion A. The position of that base plate 23 in the closed position SS relative to the furniture carcass 15 can be adjusted by way of the depth adjusting wheel 24. The ejection element 3 is mounted moveably relative to the cover 22 and to the base plate 23, respectively. The ejection force storage member 4 is held to the base plate 23 by way of the spring base 25 on the one hand and to the ejection element 3 by way of the spring base 26 on the other hand. That ejection force storage member 4 is in the form of a tension spring. Disposed on the ejection element 3 is the rotary bearing 27 at which the locking lever 28 is supported rotatably by way of the axis of rotation X. Arranged at the front end of the locking lever 28 is the locking element 6 which is of a pin-shaped configuration and which engages into the guide path 7. The retraction slider 30 is portion-wise connected to the ejection element 3, the catch arm 29 being rotatably mounted to the slider 30. In addition that retraction slider 30 has the latching engagement abutment 35 and the abutment 32 while the projection 34 and the pivotal abutment 33 are provided on the locking lever 28.

Figure 3:
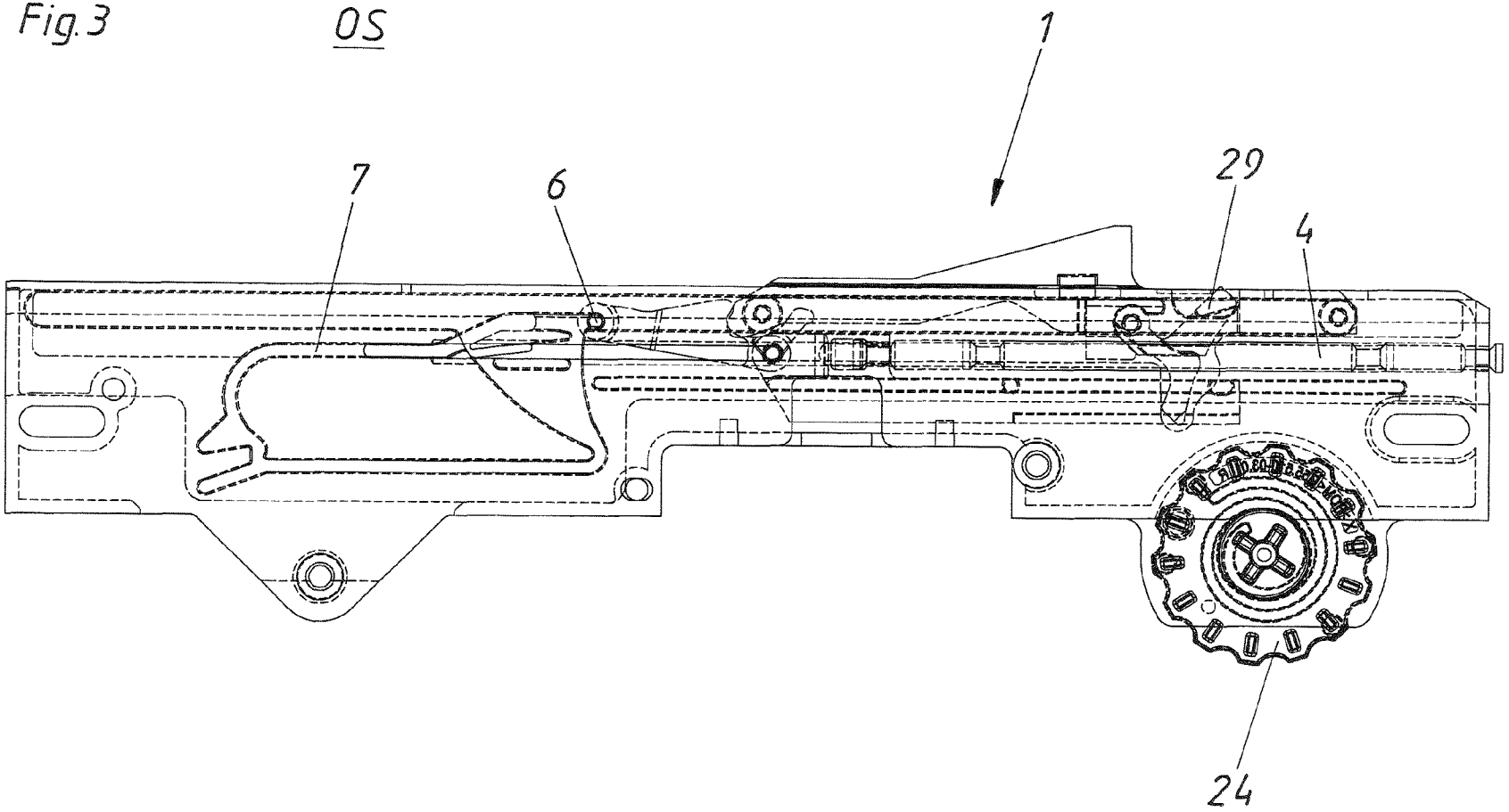
FIGS. 3 through 13 are views of the drive device with the locking element in various positions of the guide path.

FIG. 3 shows the drive device 1 when the moveable furniture part 2 is in an open position OS. In that case, the catch arm 29 is pivoted into its release position. The ejection force storage member 4 is relieved of stress. The locking element 6 is in its initial position at the beginning of the stressing portion S of the guide path 7.

Figure 4:
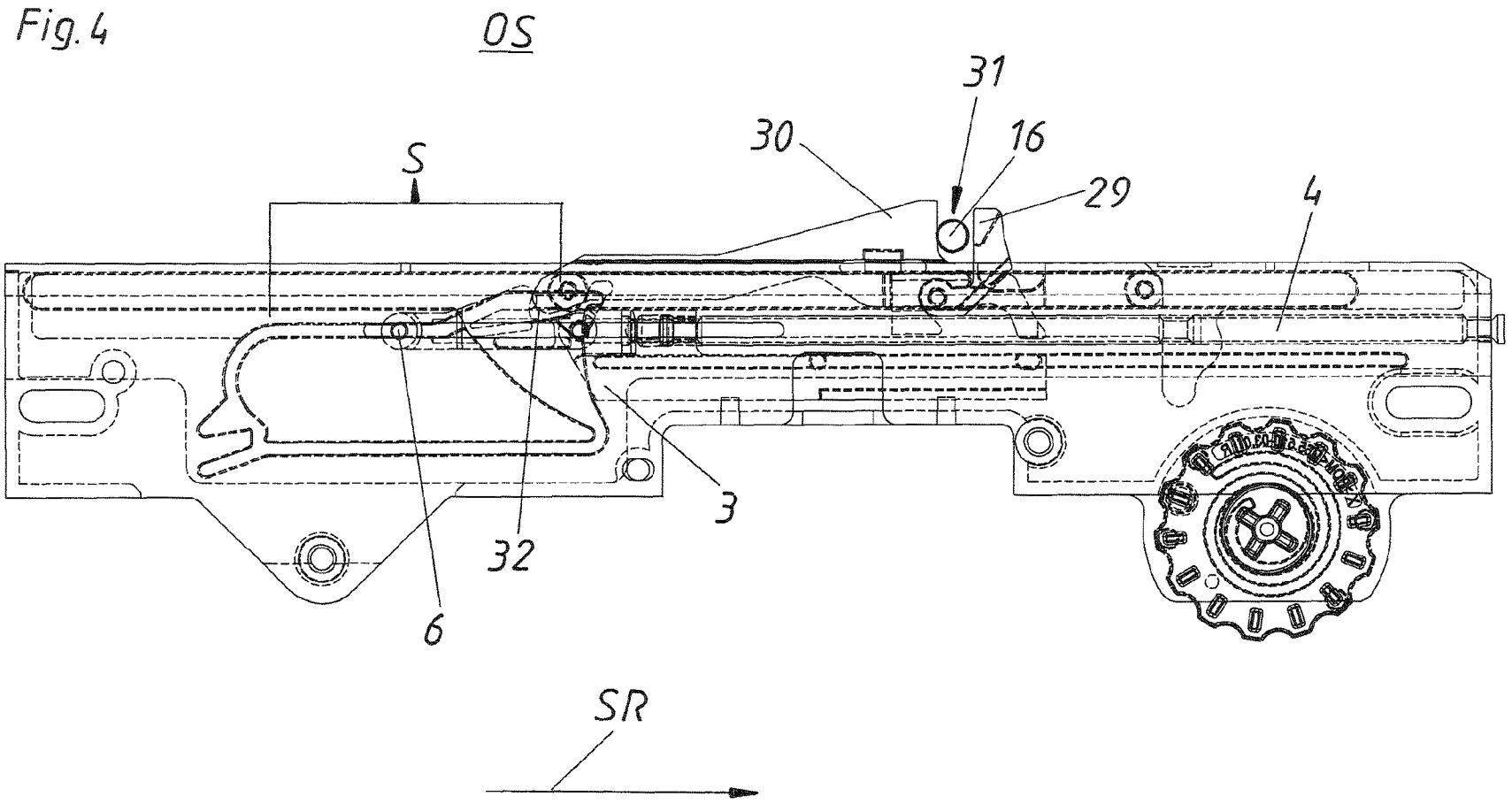

When now the moveable furniture part 2 with the drive device 1 is moved in the closing direction SR as shown in FIG. 4 the entrainment portion 16 which is fixed with respect to the carcass comes into butting contact with the retraction element 30 and moves the ejection element 3 coupled to the retraction slider 30 relative to the cover 23, in which case the locking element 6 moves along the stressing portion S and at the same time the ejection force storage member 4 fixed to the ejection element 3 is stressed. In that closing movement, the entrainment portion 16 is held or caught in the catch region 31 between the catch arm 29 which is in the catch position and the retraction slider 30.

Figure 5:
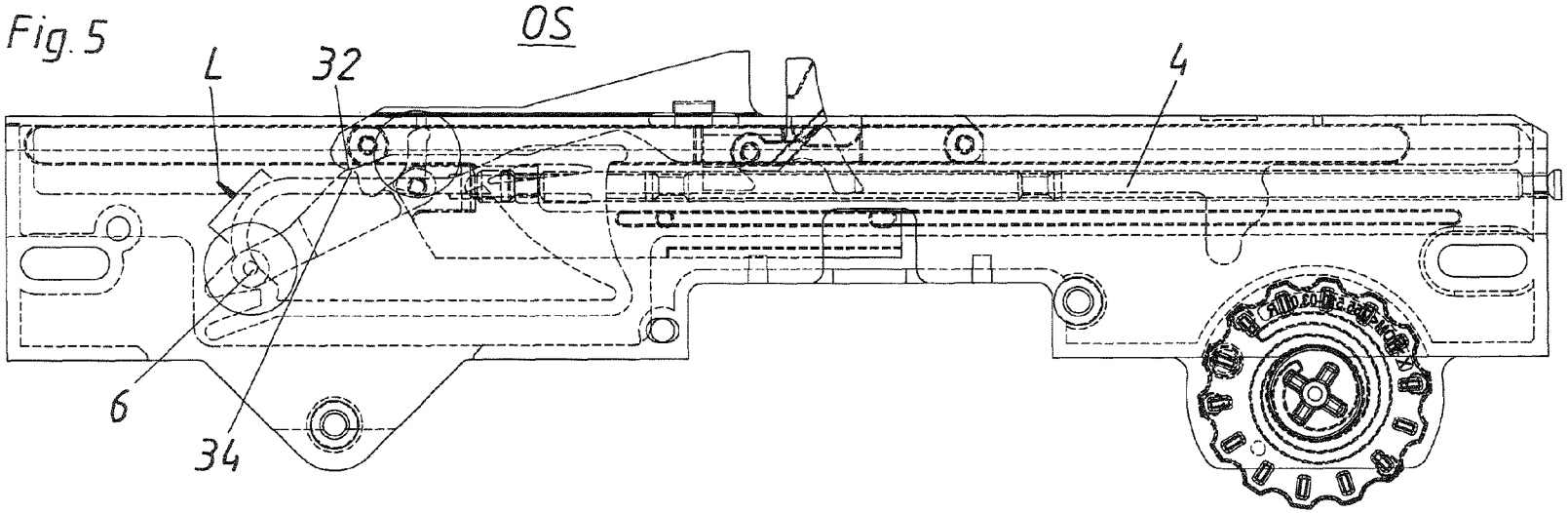
Figure 5B:
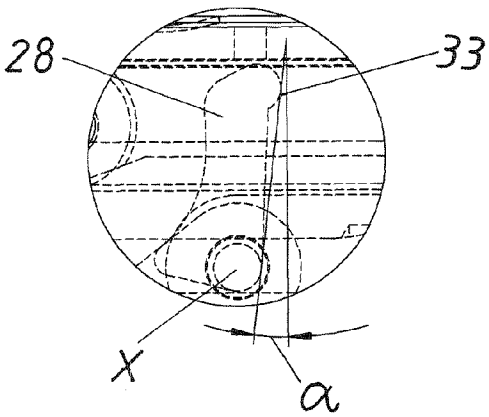
Figure 5A:
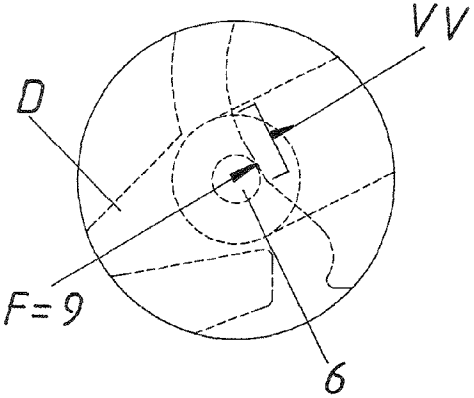

This closing movement (which in the normal case is a manual one) is continued until the position shown in FIG. 5 (still an open position OS) is reached. By virtue of the fact that the locking element 6 moves by virtue of the curved configuration of the deflecting portion L in the direction of the pre-locking portion VV the entire locking lever 28 also pivots in the counter-clockwise direction about the axis of rotation X whereby the abutment 32 of the retraction slider 30 comes out of engagement with the projection 34 on the locking lever 28, which in turn means that the ejection element 3 is uncoupled from the retraction slider 30 and thus from the manual application of force. As soon as such uncoupling has occurred the force of the ejection force storage member 4 which is now completely stressed acts directly on the locking element 6. As at that moment the locking element 6 is precisely in the pre-locking portion VV that force of the ejection force storage member 4 acts substantially normally on the straight contact surface F, that forms the holding element 9, of the guide path 7. Thus, in this position as shown in FIG. 5 the ejection element 3 is locked in the pre-locking portion VV (see in detail FIG. 5*a*). It will further be seen from the detail in FIG. 5*b* that the pivotal abutment 33 still projects by the angle α.

Figure 6:
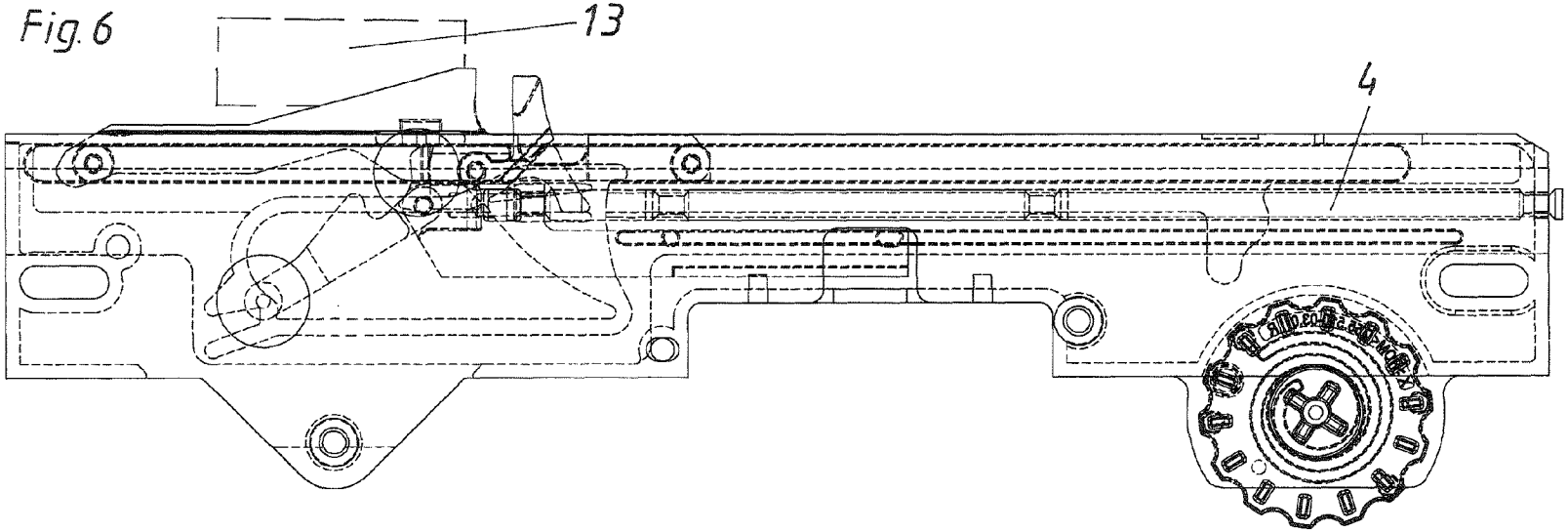
Figure 6B:
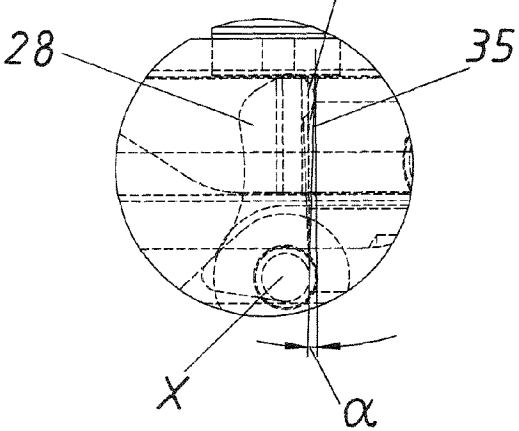
Figure 6A:
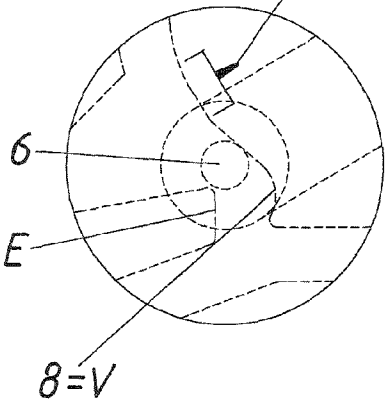

Subsequently, the retraction device 13 which is only diagrammatically shown in FIG. 4 can further move the moveable furniture part 2 together with the drive device 1 in the closing direction SR. As soon as the latching engagement abutment 35 on the retraction slider 30 comes into abutting relationship with the pivotal abutment 33 of the locking lever 28 in that movement (see FIG. 6*b*) the locking lever 28 pivots further in the counter-clockwise direction about the axis of rotation X, whereby the locking element 6 moves out of the pre-locking portion VV and moves in the direction of the trough-shaped latching region 8 forming the locking portion V (see FIG. 6*a*).

Figure 7:
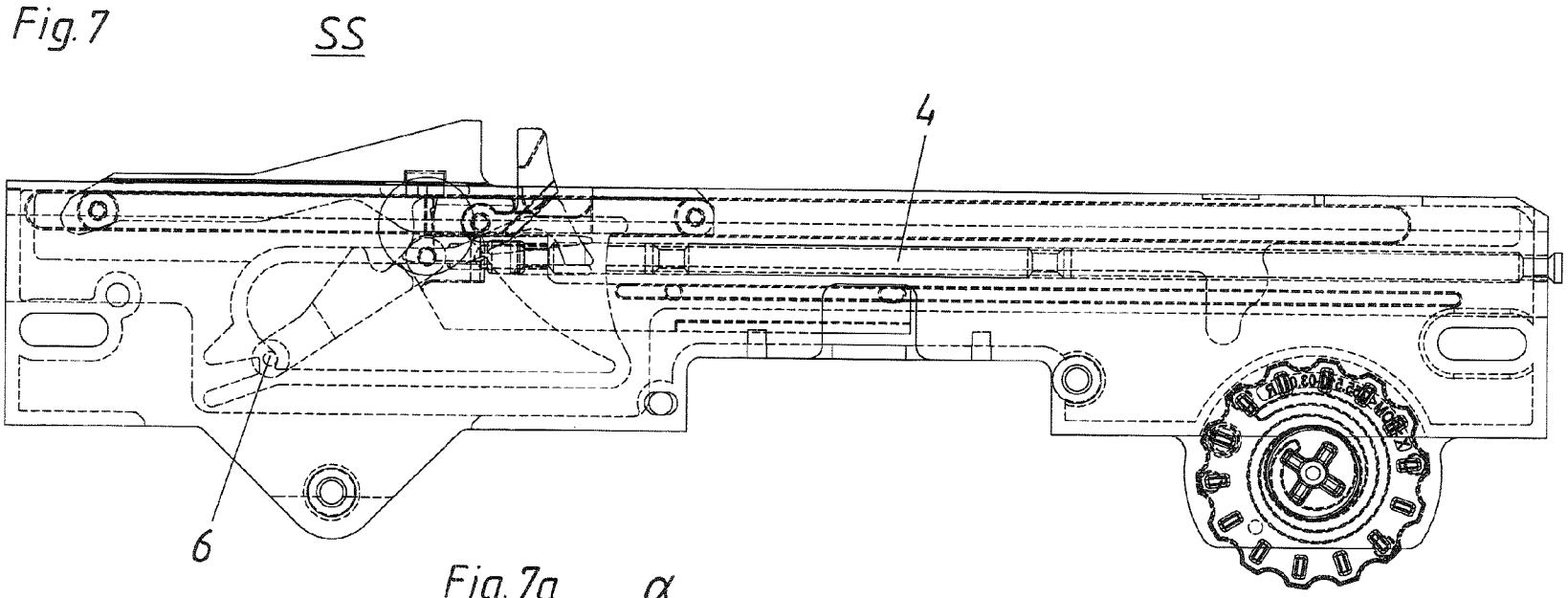
Figure 7A:
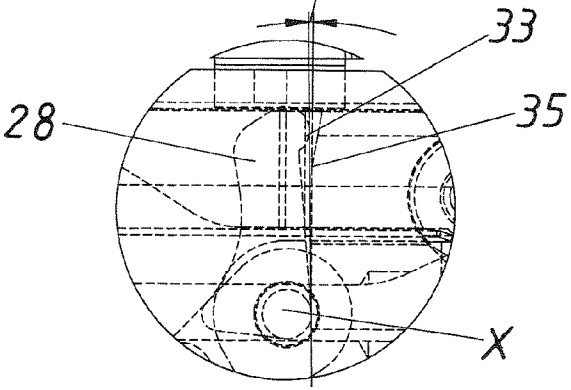

With that release of the locking element 6 from the pre-locking portion VV, the retraction device 13 has so-to-speak performed its last "work", whereupon the locking element 6, as shown in FIG. 7, passes into the locking portion V by slight stress relief of the ejection force storage member 4. Thus, the moveable furniture part 2 is in the closed position SS. As shown in FIG. 7*a* the pivotal abutment 33 is also lifted slightly from the latching engagement abutment 35 again, by virtue of that slight stress relief movement of the ejection force storage member 4.

Figure 8:
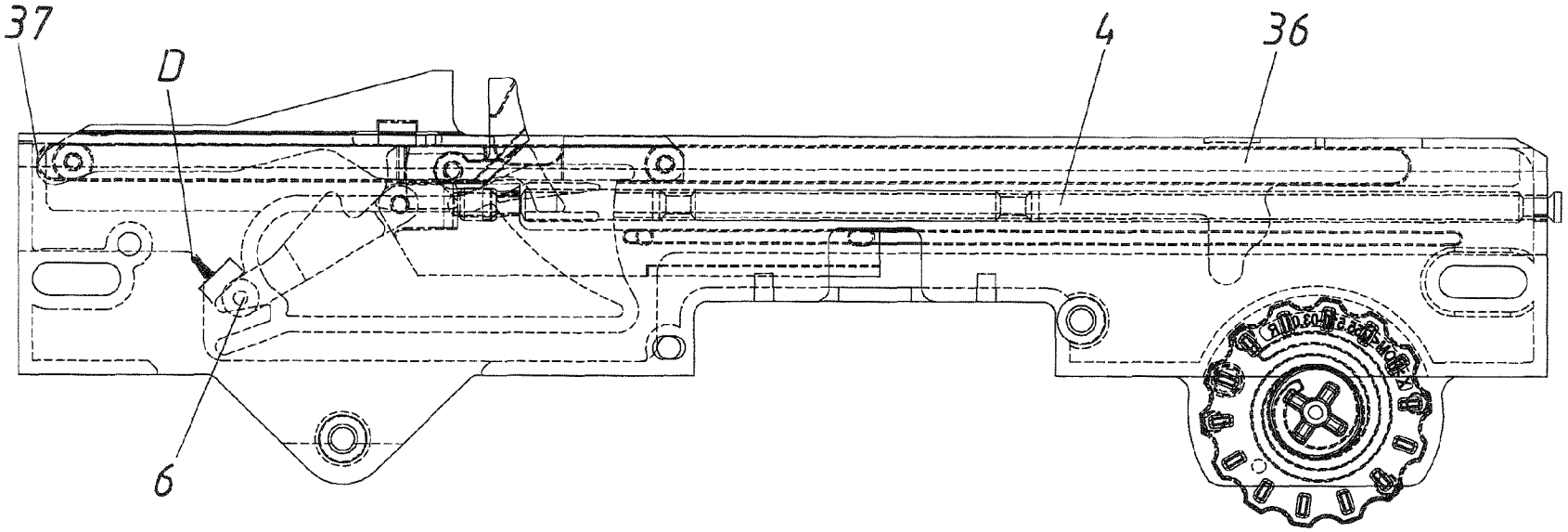

Reference is made to FIGS. 3 through 7 to describe a normal process of closing movements without incorrect operation. If however the manual closing movement does not stop as soon as the ejection force storage member 4 is stressed but the moveable furniture part 2 is even pushed further into the closed position SS and beyond same into the through-pressing position DS as shown in FIG. 8, then the locking element 6 is moved from the pre-locking portion VV into the through-pressing evasion portion D until the retraction slider 30 bears against the end 37 of its guide path 36 in the cover 23 or until the front panel 18 hits against the furniture carcass 15.

Figure 9:
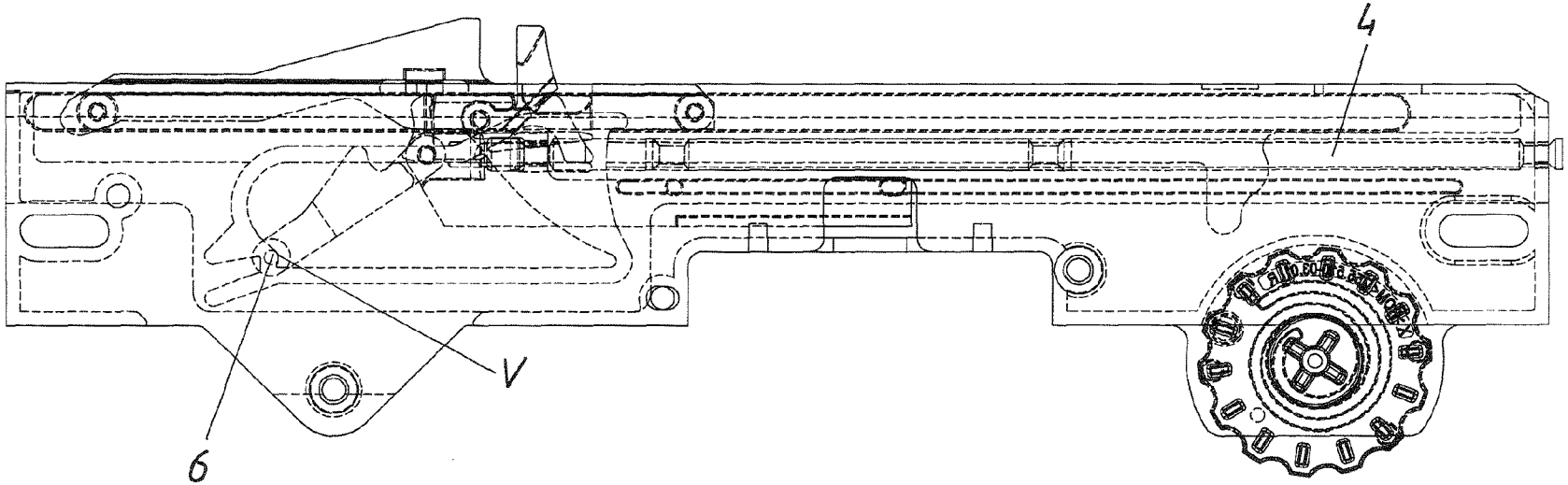

If then finally the incorrect operation has been noticed or the moveable furniture part 2 is released by virtue of the closing procedure which was wrongly completely manually performed then, by virtue of the stress relief of the ejection force storage member 4, the locking element 6 passes from the through-pressing evasion portion D into the locking portion V and the closed position SS as shown in FIG. 9 is reached. That position as shown in FIG. 9 again corresponds to the position of FIG. 7.

Figure 10:
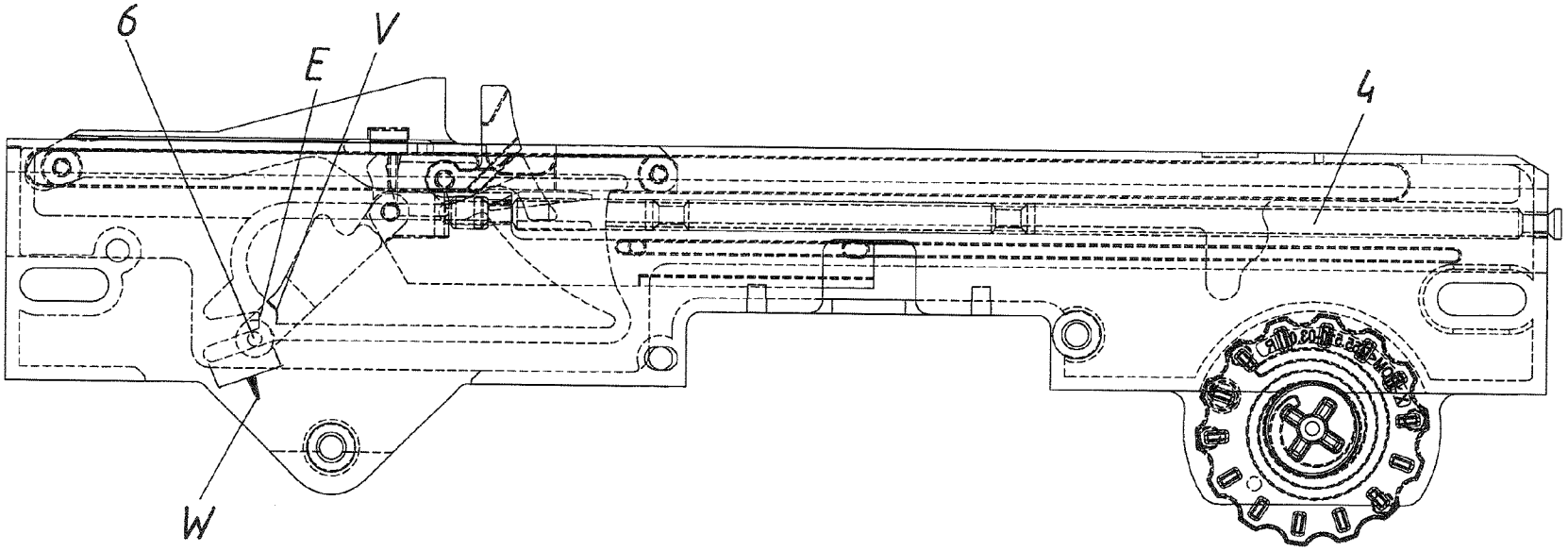

Starting from that closed position SS, the locking device 5 can be unlocked at any time by a user by over-pressing the moveable furniture part 2 in the closing direction SR. In that case, as is known per se, the locking element 6 passes by way of the diversion and unlocking portion E into the second evasion portion W (see FIG. 10), whereby the over-pressing position ÜS as shown in FIG. 10 is reached.

Figure 11:
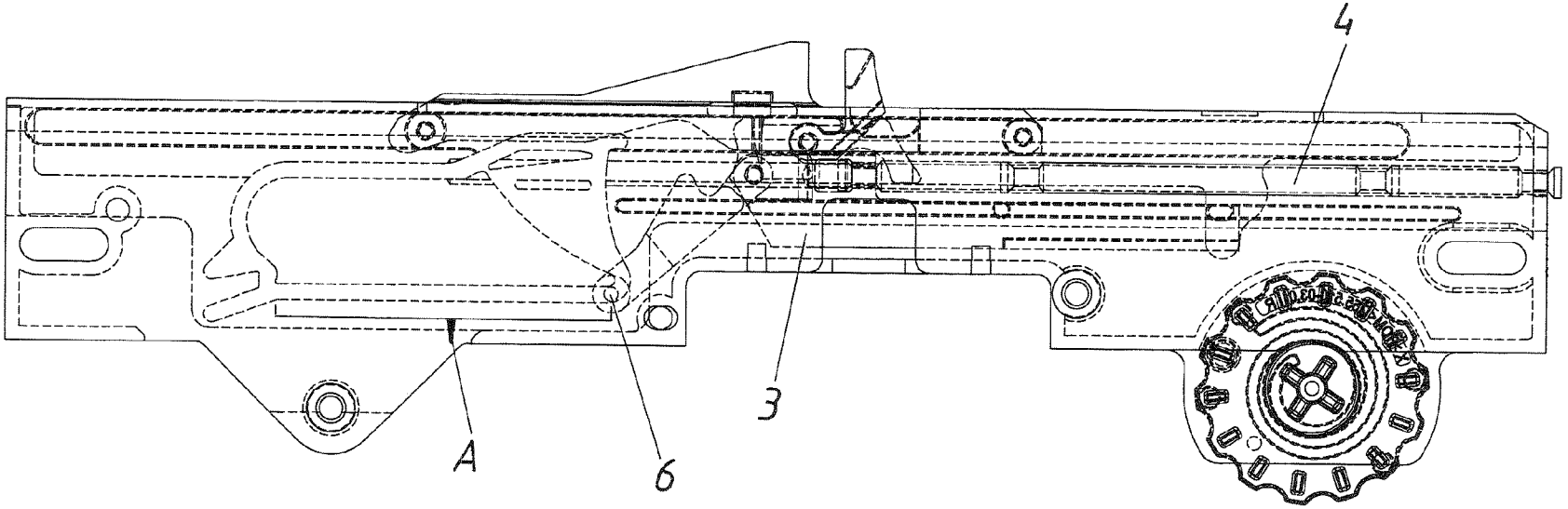

As soon as the manual unlocking movement is then concluded, the ejection force storage member 4 pulls the ejection element 3 relative to the cover 23 or the base plate 22 whereby the moveable furniture part 2 is ejected or the drive device 1 fixed to the moveable furniture part 2 pushes itself away from the entrainment portion 16 fixed with respect to the carcass. In that case the locking element 6 moves along the ejection portion A of the guide path 7 and the moveable furniture part 2 passes into the open position OS of FIG. 11.

Upon further opening movement, the retraction slider 30 is again coupled to the ejection element 3, in which case the locking lever 28 is pivoted and the locking element 6 is again moved in the direction of the initial position.

Figure 12:
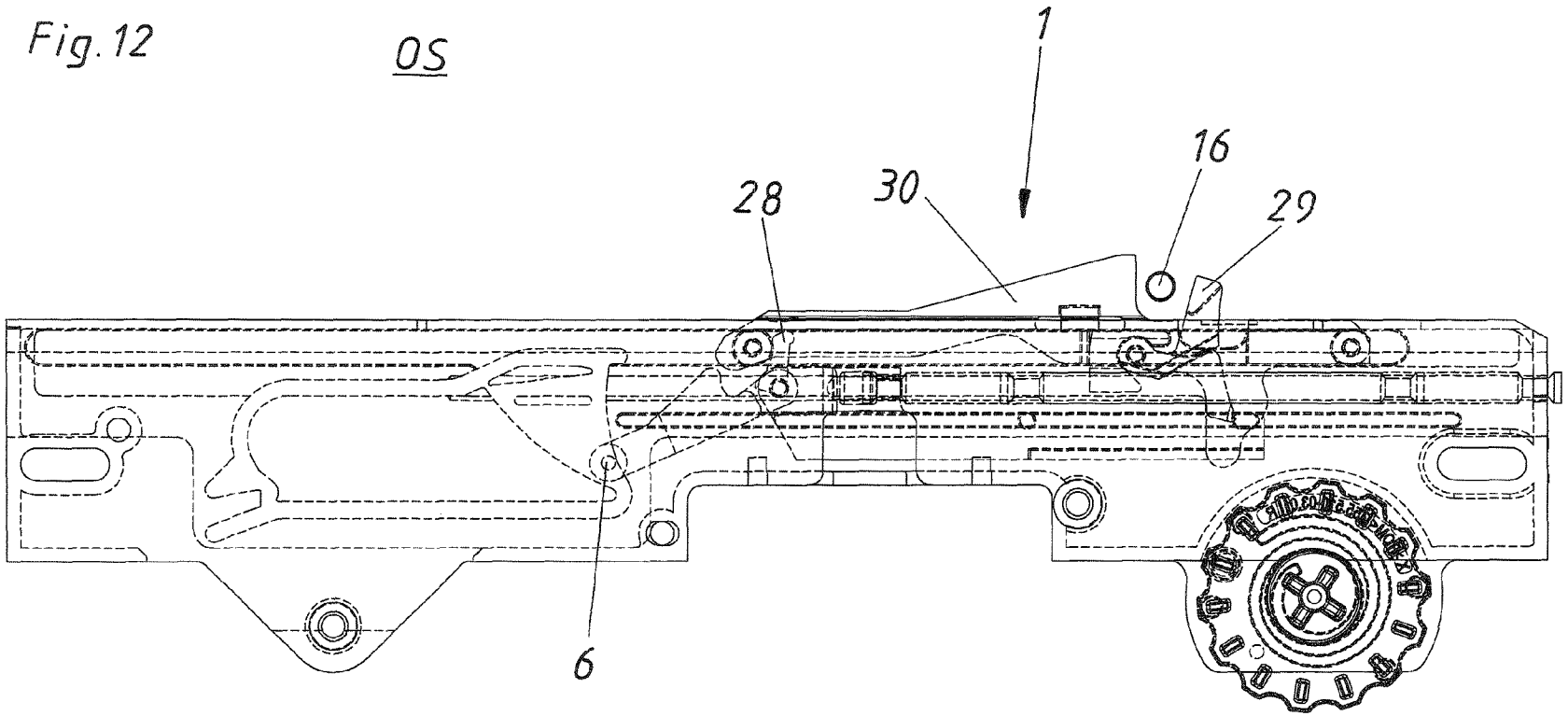

At the same time, as shown in FIG. 12, the entrainment portion 16 is released again by the pivotal movement of the catch arm 29.

Figure 13:
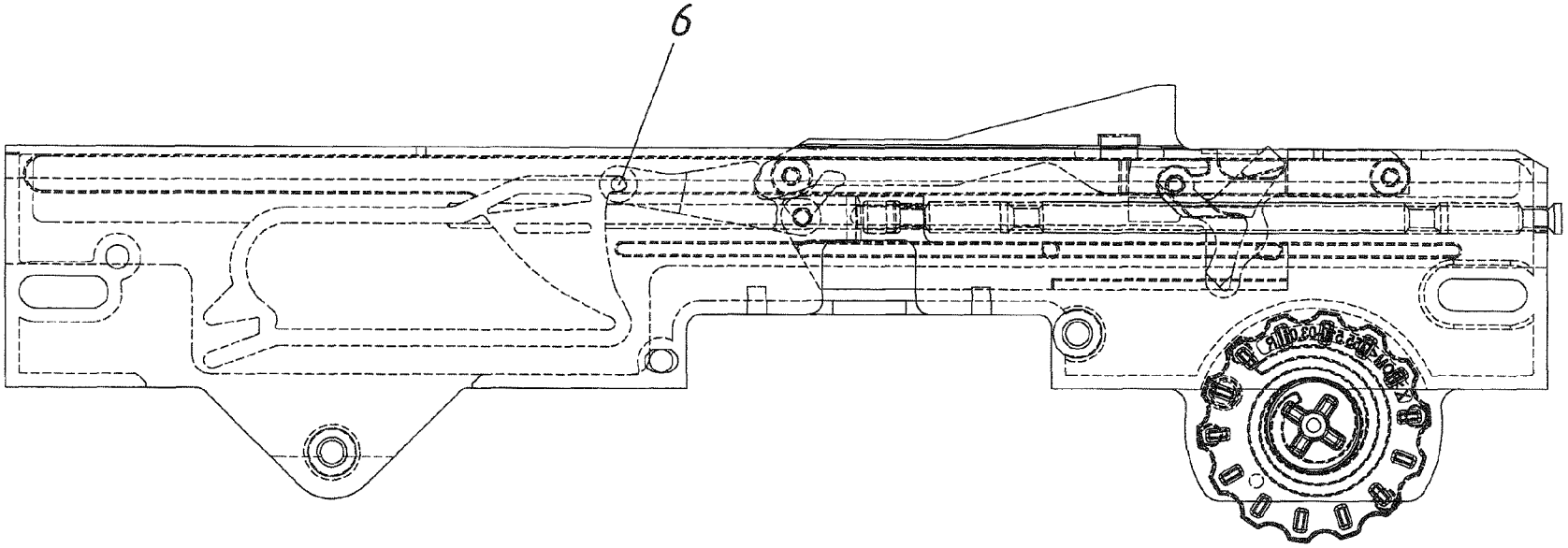

In FIG. 13, the locking element 6 is again in its initial position, the catch arm 29 is again completely opened and the moveable furniture part 2 which is in the open position OS is freely moveable independently of the entrainment portion 16.

Figure 14:
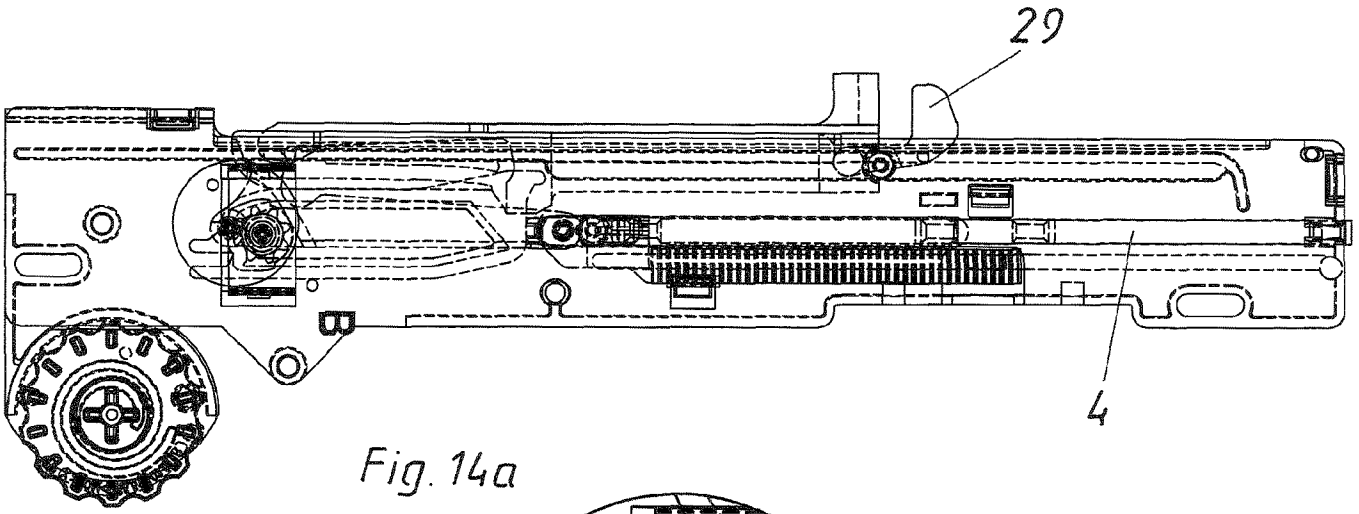
FIGS. 14 and 15 show a second embodiment of a drive device with a damping element in the pre-locking portion.
Figure 14A:
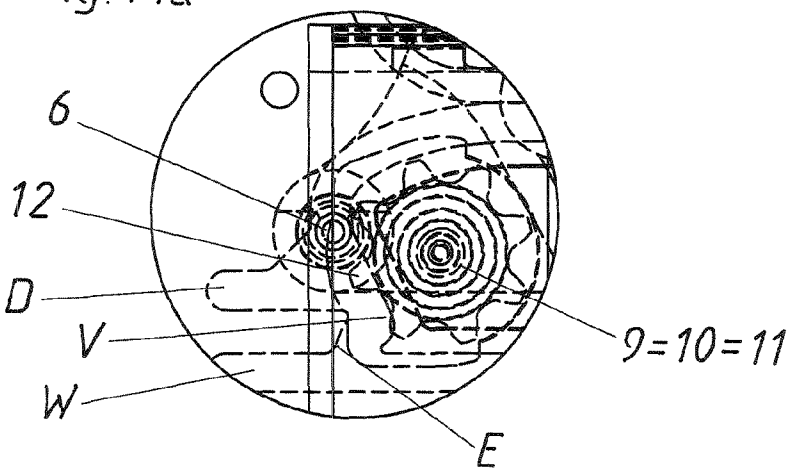
Figure 15:
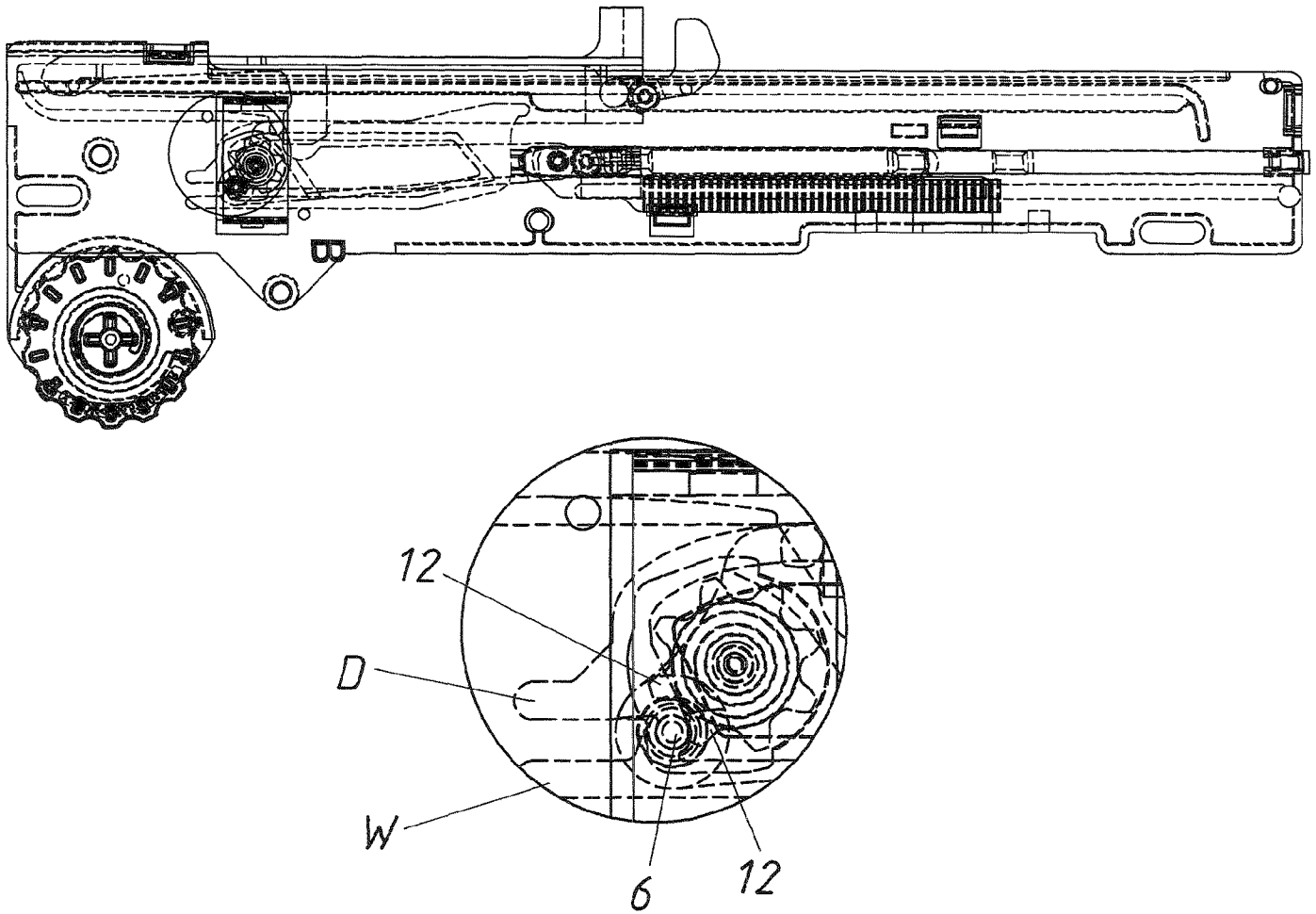

As an alternative to the holding element 9 which is in the form of a straight contact surface F, FIG. 13 shows that the holding element 9 is in the form of a damping element 10 and more specifically a gear 11. That gear 11 projects with its teeth into the pre-locking portion VV of the guide path 7. As soon as the locking element 6 has reached the position of FIG. 14*a* it is moved by the ejection force storage member 4 or by a corresponding deflection in the direction of the locking portion V. When the locking element 6 bears against the tooth 12 projecting into the pre-locking portion VV the movement of the locking element 6, triggered by the ejection force storage member 4, is damped, insofar as the gear 11 mounted rotatably in a viscous material moves only very slowly in the counter-clockwise direction. As soon as the gear 11 has moved through about 30 degrees, the locking element 6 no longer contacts the tooth 12 and passes into the locking portion V in FIG. 15 whereby the moveable furniture part 2 is in the closed position SS. Because the locking element 6 is in the pre-locking portion VV relatively long, depending on the respective duration of the rotary movement of the damping element 10, the locking element, when the moveable furniture part 2 is pressed through beyond the closed position (incorrect operation), can move into the through-pressing evasion portion D and from there after the end of the incorrect operation can pass into the actual locking portion V.

Thus, the present invention provides an improved protection against movement into the through-pressing position, insofar as the locking element 6 is not immediately locked in the locking element V but, before reaching the closed position SS of the moveable furniture part 2, is still locked in a pre-locking portion VV so that, when the moveable furniture part is pushed into the through-pressing position, the through-pressing evasion portion D is available for the locking element 6.

The invention claimed is:

1. A drive device for moving a moveable furniture part, said drive device comprising:

an ejection element to be connected to the moveable furniture part and configured to move the moveable furniture part from a closed position into an open position;

an ejection force storage member configured to act with force on the ejection element;

a locking device including a locking element for locking the ejection element in a locking portion, said locking device being configured such that, by over-pressing the moveable furniture part from the closed position in a closing direction into an over-pressing position, the locking device is unlocked to allow the moveable furniture part to be moveable in the opening direction by the ejection force storage member and the ejection element, the locking device further includes a pre-locking portion for receiving the locking element, the locking device being further configured such that, by pressing the moveable furniture part upon closing thereof into a through-pressing position behind the closed position in the closing direction, the locking element passes from the pre-locking portion into the locking portion by way of a through-pressing evasion portion; and a holding element for the locking element arranged or provided in the pre-locking portion.

2. The drive device as set forth in claim 1, wherein the locking portion is different from the pre-locking portion, wherein the pre-locking portion is located behind the locking portion in the closing direction.

3. The drive device as set forth in claim 1, wherein the locking device has a guide path for guiding the locking element, wherein the locking element is configured to be held in the locking portion in a latching region of the guide path.

4. The drive device as set forth in claim 3, wherein the guide path successively has a stressing portion, a deflecting portion, the pre-locking portion, the locking portion in the form of a latching region, an inclined diversion or unlocking portion and an ejection portion.

5. The drive device as set forth in claim 4, wherein between the inclined unlocking or diversion portion and the ejection portion, the guide path has a second evasion portion separate from the through-pressing evasion portion for the locking element.

6. The drive device as set forth in claim 4, wherein the deflecting portion is curved and the latching region is trough-shaped.

7. The drive device as set forth in claim 3, wherein the guide path is cardioid-shaped, the locking element is pin-shaped, and the latching region is trough-shaped.

8. The drive device as set forth in claim 1, wherein, in the pre-locking portion, the guide path has a straight contact surface for the locking element, the straight contact surface serving as the holding element.

9. The drive device as set forth in claim 1, wherein the holding element is a moveable damping element.

10. The drive device as set forth in claim 9, wherein the damping element has a dampedly rotatably mounted gear, wherein the gear is configured such that at least one tooth of the gear can be contacted in the pre-locking portion by the locking element and is dampedly moveable in the direction of the locking portion.

11. The drive device as set forth in claim 9, wherein the holding element is a rotational damper.

12. The drive device as set forth in claim 1, wherein the ejection force storage member is loadable by moving the moveable furniture part in the opening direction and/or in the closing direction.

13. The drive device as set forth in claim 12, wherein the ejection element is lockable in the pre-locking portion by the locking element only after complete loading of the ejection force storage member.

14. The drive device as set forth in claim 1, further comprising a retraction device for retraction of the moveable furniture part from an open position into the closed position.

15. The drive device as set forth in claim 14, wherein, when the locking element reaches the pre-locking portion, the moveable furniture part is in an open position and the moveable furniture part is moveable from that open position into the closed position by the retraction device.

16. The drive device as set forth in claim 14, wherein the locking element is moveable from the pre-locking portion into the locking portion only via the movement of the moveable furniture part by the retraction device into the closed position.

17. The drive device as set forth in claim 16, wherein the locking element is moveable from the pre-locking portion into the locking portion depending on the retraction device.

18. An article of furniture comprising:

a furniture carcass;

a moveable furniture part moveable relative to the furniture carcass; and the drive device as set forth in claim 1 for moving the moveable furniture part.

19. The article of furniture as set forth in claim 18, wherein the drive device is arranged on the moveable furniture part, and the article of furniture further comprises an entrainment portion to be brought into engagement with the ejection element and arranged on the furniture carcass.

* * * * *